US005575329A

United States Patent [19]

So et al.

[11] Patent Number: 5,575,329

[45] Date of Patent: Nov. 19, 1996

[54] PASSIVE BY-PASS FOR HEAT EXCHANGERS

[75] Inventors: Allan K. So, Mississauga; Thomas F. Lemczyk, Hamilton, both of Canada

[73] Assignee: Long Manufacturing Ltd., Ontario, Canada

[21] Appl. No.: 249,016

[22] Filed: May 25, 1994

[30] Foreign Application Priority Data

Jan. 14, 1994 [CA] Canada ..... 2113519

[51] Int. Cl.[6] ..... F28F 3/08

[52] U.S. Cl. ..... 165/167; 165/176; 165/916; 123/196 AB

[58] Field of Search ..... 165/916, 176, 165/167; 123/196 AB; 184/6.22

[56] References Cited

U.S. PATENT DOCUMENTS

| | | | |
|---|---|---|---|
| 3,743,011 | 7/1973 | Frost | 165/916 X |
| 4,360,055 | 11/1982 | Frost | 165/38 |
| 4,443,188 | 4/1984 | Bühler | 165/176 X |
| 4,561,494 | 12/1985 | Frost | 165/76 |
| 4,580,625 | 4/1986 | Yamanaka et al. | 165/916 X |
| 4,638,856 | 1/1987 | Yamanaka et al. | 165/119 |
| 4,669,532 | 6/1987 | Tejima et al. | 165/167 |
| 4,800,925 | 1/1989 | Yeoman | 138/46 |
| 4,991,643 | 2/1991 | Price et al. | 165/38 |
| 5,099,912 | 3/1992 | Tajima et al. | 165/167 X |
| 5,146,980 | 9/1992 | Le Gauyer | 165/916 X |
| 5,301,642 | 4/1994 | Matsushiro et al. | 123/196 AB |

FOREIGN PATENT DOCUMENTS

| | | | |
|---|---|---|---|
| 0563951 | 10/1993 | European Pat. Off. | 165/916 |
| 60-80093 | 5/1985 | Japan . | |
| 2140908 | 12/1984 | United Kingdom | 165/916 |

*Primary Examiner*—John Rivell
*Assistant Examiner*—Christopher Atkinson
*Attorney, Agent, or Firm*—Barry R. Lipsitz

[57] ABSTRACT

A heat exchanger is disclosed for automotive lubricants and coolants wherein the heat exchanger has a calibrated bypass orifice located therein to maintain the flow therethrough at all times, particularly during cold flow operation, or high pressure transient conditions such as at engine start-up. The heat exchanger has a housing defining a fluid inlet chamber and a fluid outlet chamber. A separator is located between the inlet and outlet chambers and heat exchange passages are located between and communicate with the inlet and outlet chambers. The separator has a calibrated bypass orifice therethrough for the continuous flow of fluid between the inlet and outlet chambers bypassing the heat exchange passages.

23 Claims, 4 Drawing Sheets

PASSIVE BY-PASS FOR HEAT EXCHANGERS

BACKGROUND OF THE INVENTION

1. Field of the Invention

This invention relates to heat exchangers, and in particular, automotive type heat exchangers such as are used for cooling engine and transmission oils, or power steering or brake fluids.

2. Description of the Prior Art

Automotive heat exchangers are used with oils and other automotive fluids that are generally cold and highly viscous upon initial vehicle start-up, especially under cold ambient conditions. Further, modern automotive heat exchangers employ very tiny fluid passages and thin-walled material, to maintain the heat exchangers as small and light in weight as possible. The result is that these heat exchangers can be subjected to very high internal pressures, and flow through the heat exchangers can be blocked or severally restricted until the engine warms up and the fluid systems reach normal operating temperatures. In some cases, the problem is so severe that an engine or a transmission can be starved of lubricating oils and actually fail.

In order to overcome these problems, two approaches have been tried in the past. The first is to use what is sometimes referred to as an active bypass device. This is a bypass valve that is incorporated in the heat exchanger to switch the oil or working fluid flow from the heat exchange circuit to a bypass circuit when the fluid is cold and viscous, and to redirect the fluid back to the heat exchange circuit when the fluid is hot and of normal low viscosity. These bypass valves typically are pressure or temperature activated. An example of a pressure type bypass valve is shown in U.S. Pat. No. No. 4,360,055 issued to Donald J. Frost. This patent shows a spring type flap valve. An example of a temperature type bypass valve is shown in U.S. Pat. No. 4,669,532 issued to Masahiro Tejima et al and this patent shows the use of a bi-metallic strip type valve. Other pressure activated valves, such as spring-loaded popper valves, have been used. Other temperature activated devices employing thermal expansion techniques, such as thermally expanding plugs have also been used. A difficulty with all of these active bypass valve heat exchangers, however, is that they are difficult to manufacture resulting in high costs. Also, they are prone to failure, because they containing moving parts.

The second approach used in the past is what is sometimes referred to as the passive type of bypass. This may be in the form of an external bypass circuit such as a separate tube or channel communicating between the supply and return lines running to and from the heat exchanger. The difficulty with this is that it requires extra tubing which is expensive and prone to leaks and damage. Also, there is very little spare room in modern automotive engine compartments, so there is often not enough room for these external bypass circuits. These latter difficulties can be overcome to some extent by incorporating the bypass tubes into the main heat exchanger structure. However, this interferes with the flow distribution through the heat exchange passages and it reduces the heat transfer efficiency of the heat exchanger to such an extent that it is usually necessary to increase the size of the heat exchanger to maintain heat transfer performance within acceptable limits. Often, it is not possible to increase the size of the heat exchanger because of space limitations inside the engine compartment.

SUMMARY OF THE INVENTION

In the present invention, passive bypass is achieved by the use of a simple orifice in an internal wall of the heat exchanger allowing a portion of the working fluid to bypass the existing heat exchange passages.

According to one aspect of the invention, there is provided a heat exchanger comprising a housing defining a fluid inlet chamber and fluid outlet chamber. A separator is located between the fluid inlet and outlet chambers. Means are provided defining a plurality of heat exchange passages located between and communicating with the inlet and outlet chambers. Also, the separator defines a calibrated bypass orifice therethrough for continuous flow of fluid between the inlet and outlet chambers bypassing the heat exchange passages.

BRIEF DESCRIPTION OF THE DRAWINGS

Preferred embodiments of the invention will now be described, by way of example, with reference to the accompanying drawings in which.

DESCRIPTION OF THE PREFERRED EMBODIMENTS

Figure 2:
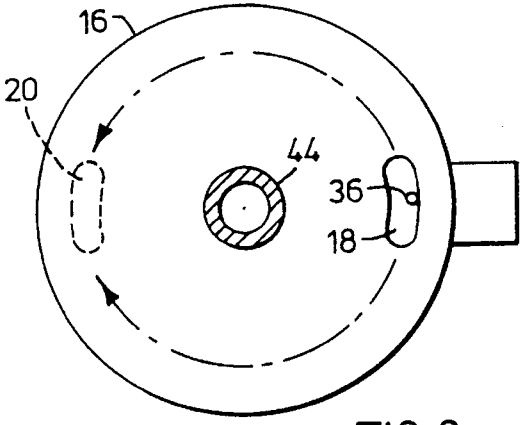
FIG. 2 is a bottom view taken along lines 2—2 of FIG. 1.
Figure 3:
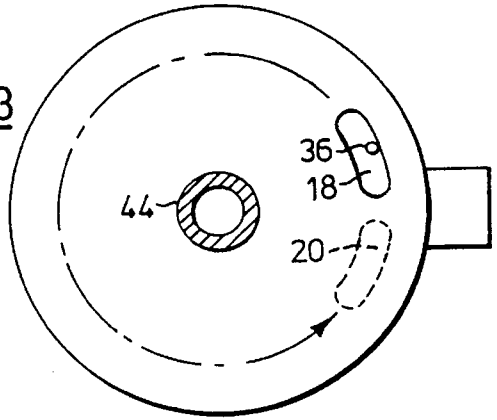
FIG. 3 is a view similar to FIG. 2 but showing an alternative fluid flow pattern through the heat exchanger of FIG. 1.
Figure 1:
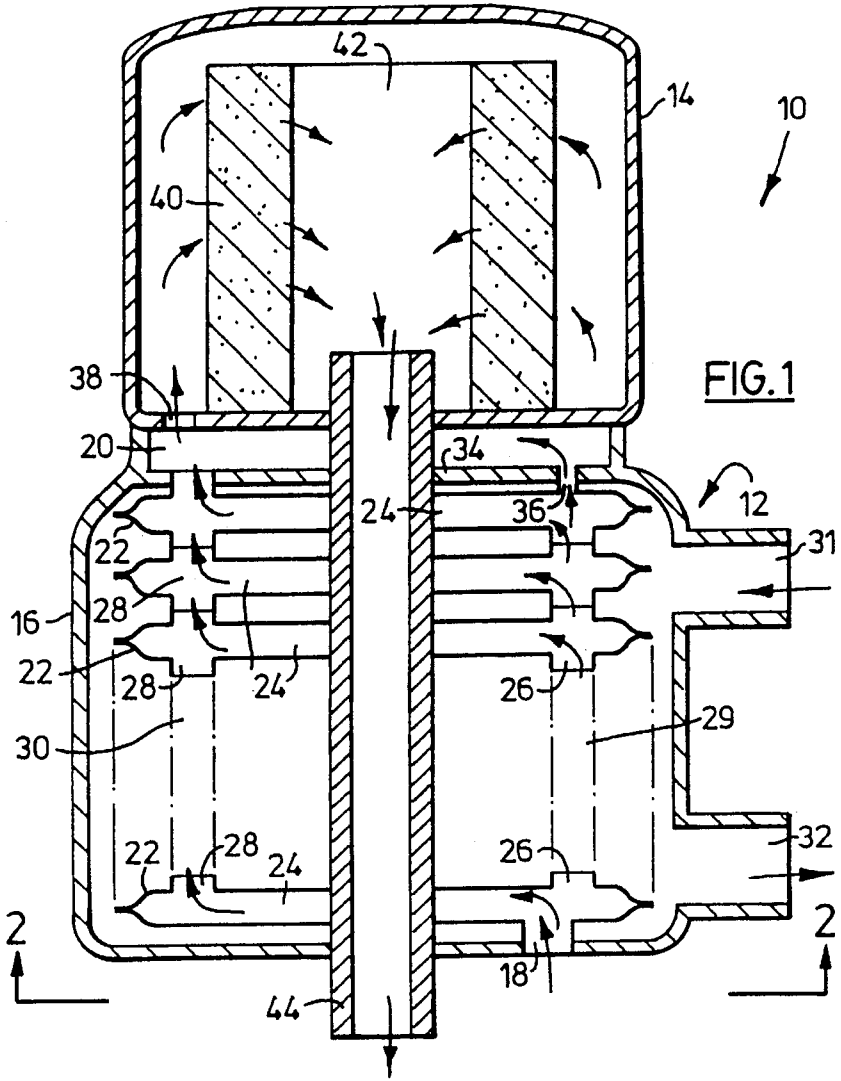
FIG. 1 is a diagrammatic vertical sectional view of a typical automotive heat exchanger and oil filter combination employing one embodiment of the present invention.

Referring firstly to FIGS. 1 to 3, a combination heat exchanger and oil filter is generally represented by reference numeral 10, and it includes a preferred embodiment of a heat exchanger according to the present invention generally indicated by reference numeral 12, and a conventional oil filter 14. Heat exchanger 12 includes a housing 16 defining a fluid inlet chamber 18 and a fluid outlet chamber 20. A plurality of stacked, circular plate pairs 22 are located inside housing 16. Plate pairs 22 define internal circular flow passages 24 for the flow of engine oil therethrough. Each plate pair 22 has an inlet passage 26 and an outlet passage 28. All of the respective inlet passages are in registration to form an inlet flow manifold 29 communicating with inlet chamber 18, and all of the respective outlet passages 28 are in registration to form a fluid outlet manifold 30 in communication with outlet chamber 20. Referring in particular to FIG. 2, it will be seen that oil entering inlet chamber 18 passes through plate pairs 22 in a split flow pattern (half clockwise and half counter clockwise) and exits into outlet chamber 20. FIG. 3 shows an alternative circumferential flow pattern wherein the outlet chamber 20 is located adjacent to inlet chamber 18.

Referring again to FIG. 1, heat exchanger housing 16 includes a coolant inlet 31 and a coolant outlet 32 for the flow of engine coolant into and out of housing 16 in heat exchange relationship with plate pairs 22.

Heat exchanger 12 also includes a top wall or separator 34 located between inlet chamber 18 and outlet chamber 20. Actually, separator 34 is located between the inlet manifold 29 and outlet chamber 20, but for the purposes of this disclosure, inlet manifold 29 can be considered to be part of inlet chamber 18. Separator 34 includes or defines a calibrated bypass orifice 36 therethrough for the continuous flow of oil or other working fluid between the inlet and outlet chambers 18, 20 bypassing the heat exchange passages located inside plate pairs 22.

Oil filter 14 has an inlet opening 38 to permit the entry of oil from outlet chamber 20. A conventional filter element 40 has a top closure element 42, so that oil entering inlet opening 38 flows around and through filter element 40 to exit through a central tube 44.

In operation, oil enters inlet chamber 18 to inlet flow manifold 29. The majority of the oil flows through plate pairs 22 to outlet manifold 30 and then up into outlet chamber 20, but a bypass flow passes through orifice 36 into outlet chamber 20. The entire oil flow then passes through oil filter inlet opening 38 to pass through the oil filter and exit through central tube 44. Outlet chamber 20 is an annular chamber, so that the bypass flow through orifice 36 passes around tube 44 to join the main oil output flow entering inlet opening 38.

Figure 4:
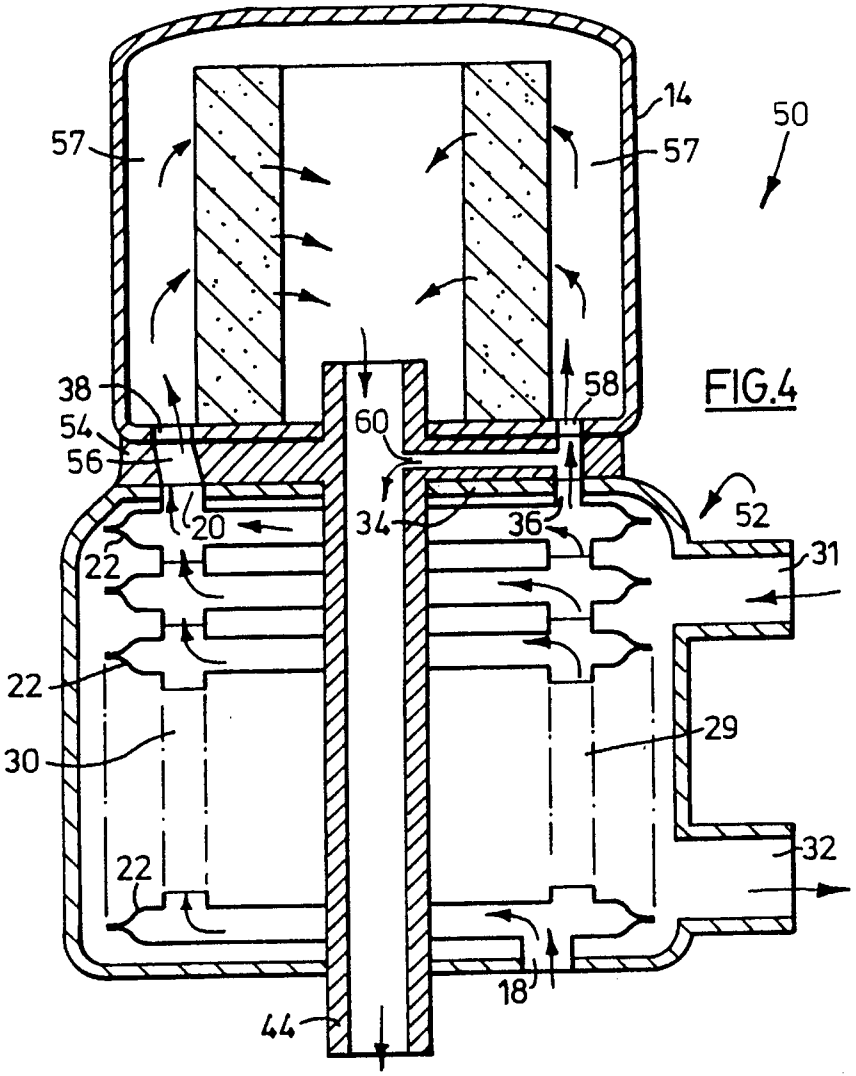
FIG. 4 is a view similar to FIG. 1, but showing an alternative embodiment employing two orifices.

Referring next to FIG. 4, another embodiment of a heat exchanger and oil filter combination is generally indicated by reference numeral 50. In this embodiment, a heat exchanger 52 is generally the same as heat exchanger 12 in FIG. 1, so like reference numerals will be used to indicate similar parts. In heat exchanger 52, however, outlet chamber 20 is actually part of the upper end of fluid outlet manifold 30, and orifice 36 is slightly larger than the embodiment shown in FIG. 1. In this embodiment, centre tube 44 has an annular flange 54. A through passage 56 in flange 54 communicates with and forms part of outlet chamber 20. Filter inlet opening 38 joins through passage 56 to a filter chamber 57, which communicates with tube 44. For the purposes of this disclosure, through passage 56, filter chamber 57 and tube 44 all form part of outlet chamber 20. Filter 14 also has a bypass inlet 58 communicating with orifice 36, and flange 54 has a further radial bypass 60 also communicating with orifice 36. In this embodiment, a portion of the bypass flow exiting through orifice 36 passes into outlet chamber 20 by way of filter chamber 57, and a portion of this bypass flow passes directly into tube 44 through radial bypass 60. In this way, if the filter becomes blocked or clogged, there is still a bypass flow through radial bypass channel 60.

Figure 5:
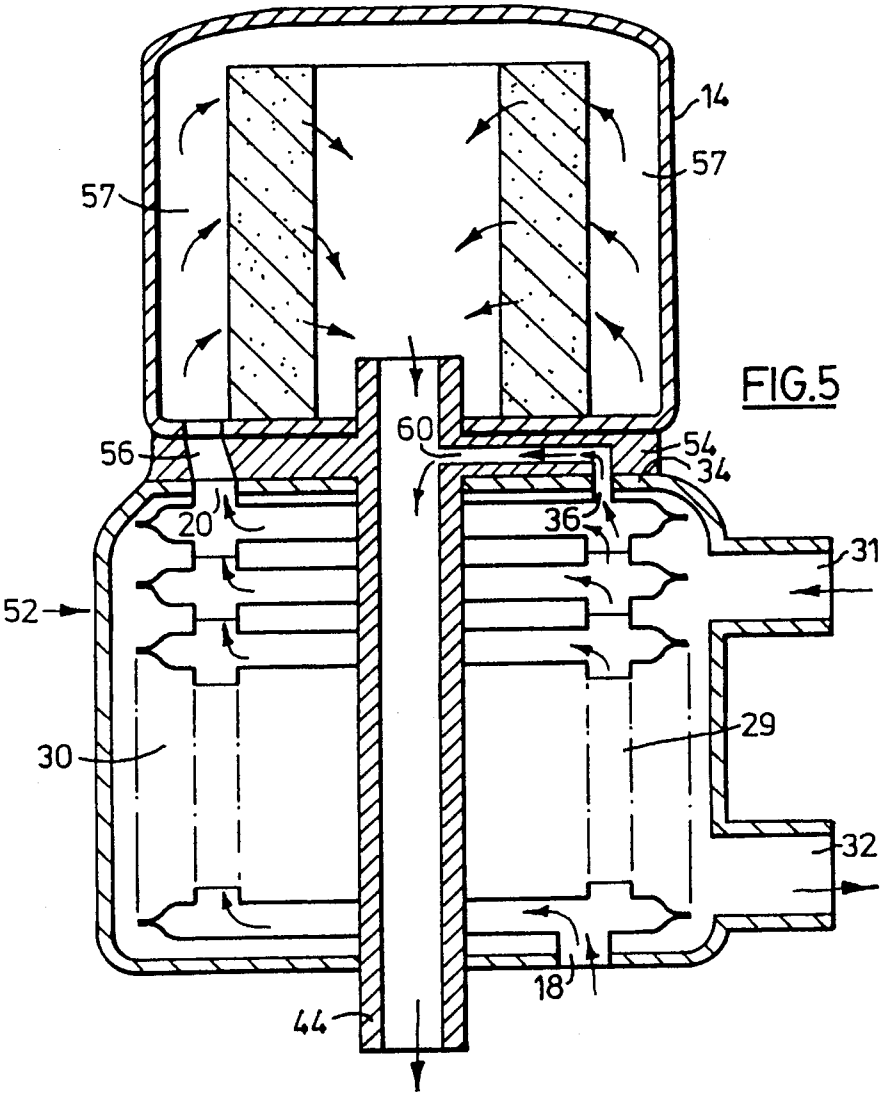
FIG. 5 is a view similar to FIG. 1 showing yet another embodiment of the orifice.

The embodiment shown in FIG. 5 is similar to that shown in FIG. 4, but there is a single radial bypass channel 60 and no bypass flow passing through filter 14.

In the embodiments shown in FIGS. 4 and 5, the flange 54 forms a flow diverter located between orifice 36 and the fluid outlet chamber 20 (including through passage 56 and filter chamber 57). Bypass channel 60 formed in this flow diverter communicates between orifice 36 and outlet chamber 20 (tube 44).

Figure 6:
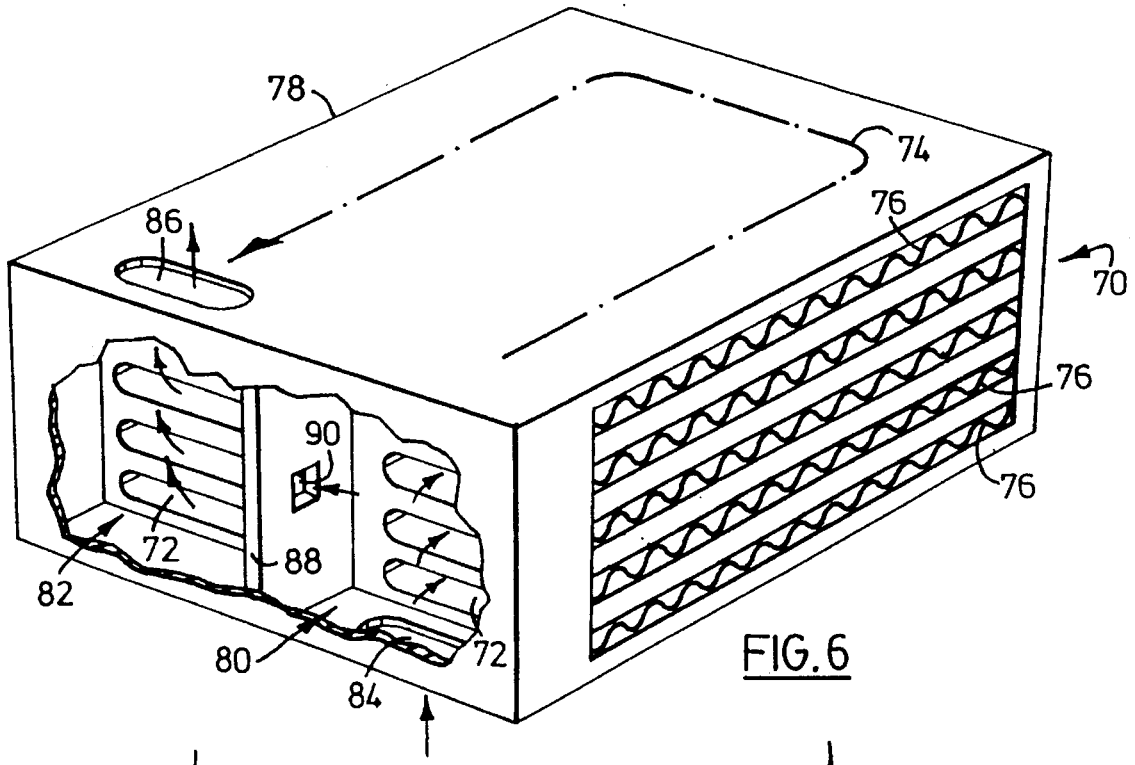
FIG. 6 is a diagrammatic perspective view, partly broken away, showing another type of automotive heat exchanger.

Referring next to FIG. 6, a heat exchanger 70 is shown which includes a plurality of elongate tubes or plate pairs defining longitudinal flow passages 72 through which oil flows in a U-shaped pattern as indicated in chain-dotted lines 74. Dimples or fins 76 are located between the plates or tubes that form flow passages 72 and coolant flows through fins 76 in a direction transverse to flow passages 72 in heat exchange relationship with the oil or working fluid flowing through passages 72. A housing 78 defines a fluid inlet chamber 80 and a fluid outlet chamber 82 communicating with heat exchange flow passages 72. An inlet opening 84 communicates with inlet chamber 80 and an outlet opening 86 communicates with outlet chamber 82. A separator 88 is located between inlet and outlet chambers 80, 82. Separator 88 is in the form of a plate or baffle and has an orifice 90 in the form of a hole in the plate. Orifice 90 could be round or rectangular or some other configuration to minimize pressure losses therethrough when the fluid static pressure in fluid inlet chamber 80 is highest, as will be appreciated by those skilled in the art.

It will also be appreciated that in the FIG. 6 embodiment, the inlet and outlet openings 84, 86 could be re-located to some other location in the walls of housing 78 that form inlet and outlet chambers 80, 82. Also, there could be a rear cross-over manifold at the rear or back side of heat exchanger 70 rather than using U-shaped tubes or plate passages as indicated in FIG. 6.

Figure 7:
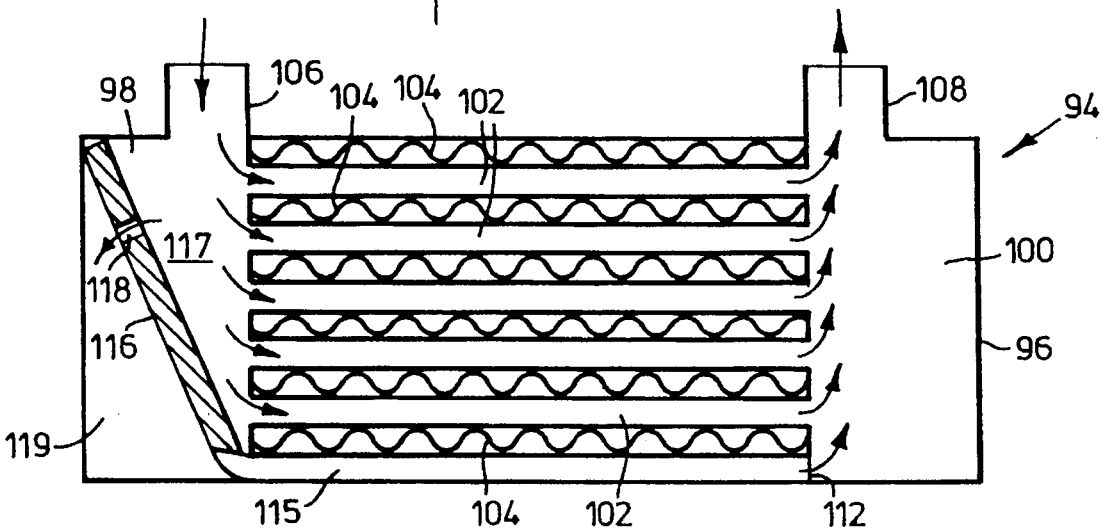
FIG. 7 is a diagrammatic vertical sectional view showing yet another type of automotive heat exchanger.
Figure 8:
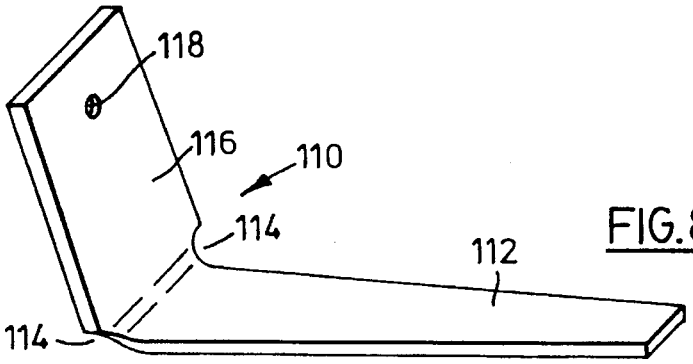
FIG. 8 is a perspective view of a flow diverter or baffle used in the embodiment shown in FIG. 7.

Referring next to FIG. 7, an in-line heat exchanger 94 is shown having a housing 96 defining an inlet chamber 98 and an outlet chamber 100. A plurality of fluid heat exchange passages 102 are arranged to communicate between inlet and outlet chambers 98, 100. Dimples or fins 104 fill the spaces between flow passages 102 for the flow of coolant therethrough in a direction transverse to the direction of flow of the working fluid through flow passages 102. A fluid inlet 106 supplies working fluid to inlet chamber 98 and a fluid outlet 108 allows for the exit of working fluid from fluid outlet chamber 100. A flow diverter 110 (see FIG. 8) is located inside housing 96 below the fluid flow passages 102 and fins 104. Flow diverter 110 includes a lower plate 112 which is tapered starting from notches 114 to form a flow passage or bypass channel 115 allowing coolant to flow longitudinally beside lower plate 112 from inlet chamber 98 to outlet chamber 100. A separator or baffle 116 is also formed integrally with lower plate 112. Separator 116 is disposed at an angle inside inlet chamber 98 to form a taper-flow manifold 117 and a bypass chamber 119 for the working fluid entering inlet chamber 98. A bypass orifice 118 is formed in baffle or separator 116 for the bypass flow of working fluid from the inlet chamber 98 through bypass chamber 119 to outlet chamber 100 along bypass channel 115 beside diverter lower plate 112.

Figure 9:
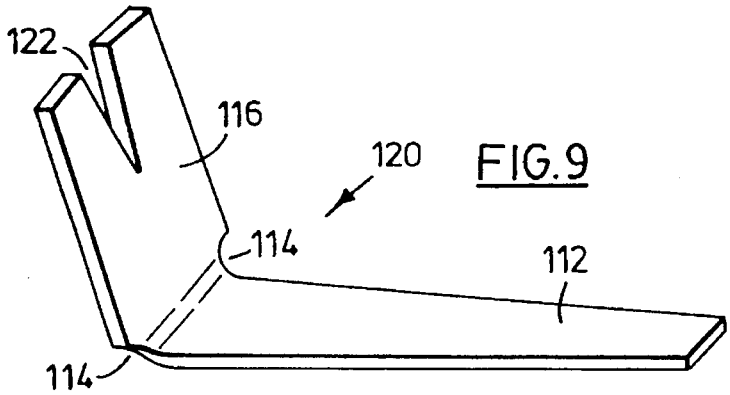
FIG. 9 is a view similar to FIG. 8 but showing another embodiment of the flow diverter.

FIG. 9 shows an alternative embodiment of a flow diverter 120 wherein the orifice is in the form of a notch or slot 122. In the event that inlet chamber 98 is not completely filled with working fluid, only a small bypass flow would occur at the apex of notch 122, and as inlet chamber fills up and pressure increases therein, the bypass flow increases as notch 122 widens.

Figure 10:
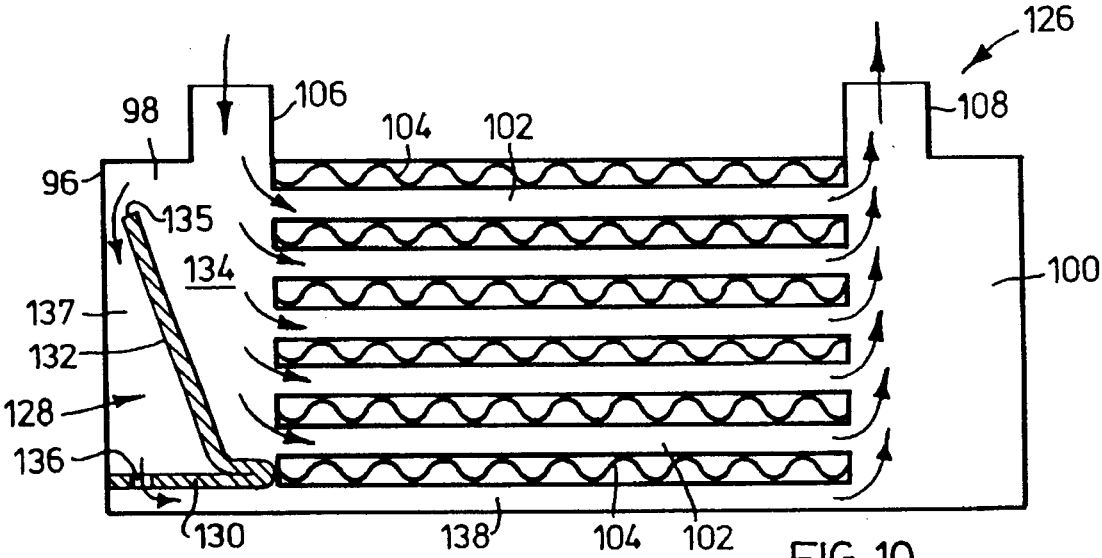
FIG. 10 is a diagrammatic vertical sectional view similar to FIG. 7, but showing yet another embodiment of the baffle.

Referring next to FIG. 10, an in-line heat exchanger 126 is shown that is similar to the embodiment shown in FIG. 7, but in this embodiment, the flow diverter 128 includes a horizontal plate 130 which also acts as a separator and an upright baffle 132. Baffle 132 causes inlet chamber 98 to form a taper-flow manifold 134. The upper end of baffle 132 stops short of housing 96 to form a dam 135 over which the working fluid flows to pass into a bypass chamber 137 and then through orifice 136. A bypass channel 138 formed in part by diverter plate 130 allows the bypass fluid flow to pass under flow passages 102 and fins 104 to outlet chamber 100.

Figure 11:
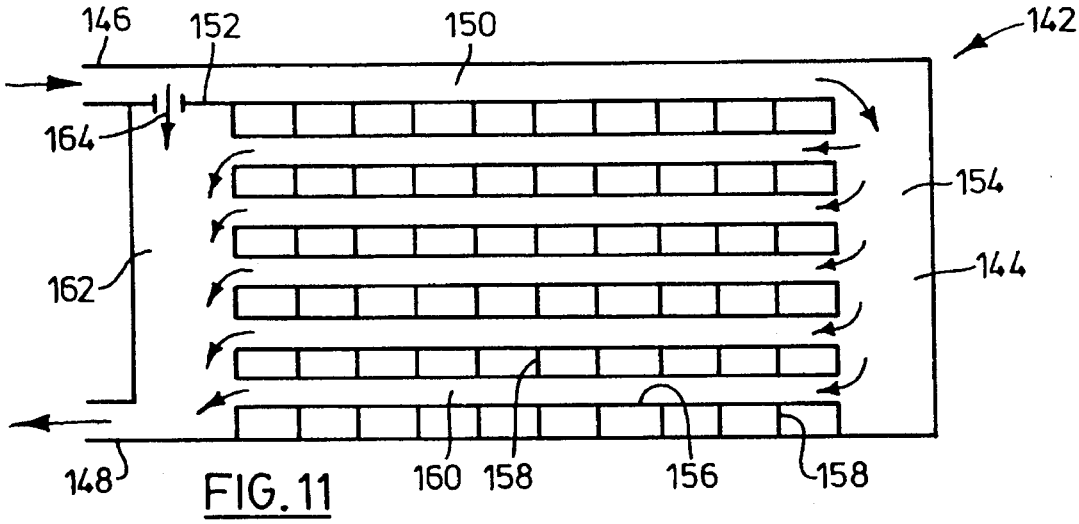
FIG. 11 is a diagrammatic vertical sectional view of yet another embodiment of an automotive heat exchanger employing a bypass orifice according to the present invention.

FIG. 11 shows a heat exchanger 142 having a housing 144, fluid inlet 146 and a fluid outlet 148. A longitudinal flow passage 150 formed in part by a diverter or separator 152 allows working fluid to pass from inlet 146 to inlet chamber 154. Stacked plate pairs or tubes 156 with fins 158 therebetween form longitudinal flow passages 160 in heat exchanger 142 allowing the working fluid to pass from inlet chamber 154 to an outlet chamber 162. An orifice 164 formed in separator 152 provides the bypass flow, and for the purposes of this disclosure, flow passage 150 is considered to be part of inlet chamber 154. Fluid flows transversely through heat exchanger 142 through the spaces between plates or tubes 156 that are occupied by fins 158 as in the embodiment shown in FIGS. 7 and 10.

In all of the embodiments described above, the bypass orifices are located so that they have minimal negative effect on the flow distribution through the heat exchange passages. This normally means that the orifices are located remote from or as far from the heat exchange passages as possible. Preferably, the orifices are located in the heat exchanger where the fluid static pressure is generally the highest and the fluid dynamic pressure is generally the lowest, subject to manufacturing considerations, such as the orifice being plugged during the manufacturing process, which typically is a brazing or soldering process.

It will be appreciated that the flow through the bypass orifices reduces the heat transfer efficiency in the heat exchanger, because less fluid is going through the heat exchange passages. The orifices are dimensioned so that this reduction in heat transfer does not exceed a predetermined limit under normal operating conditions. In the case of an engine oil cooler this predetermined limit is as low as 5% of the heat transfer rate of the heat exchanger without an orifice. In the case of a transmission oil cooler, the predetermined limit is as low as 10% of the heat transfer rate of the heat exchanger without an orifice. However, the predetermined limit could be as high as 25% of the heat transfer rate of the heat exchanger without an orifice. Alternatively, it may be possible to increase the efficiency of the heat exchanger or increase the size or number of the heat exchanger plates or tubes and fins used to make the heat exchange passages in order to make up for the reduction in heat transfer caused by the bypass flow.

The bypass orifices are also dimensioned so as to reduce the fluid pressure drop in the heat exchanger by a predetermined minimum amount compared to the same heat exchanger with no orifice. This predetermined minimum amount is normally between 10 and 30% under normal steady state heat exchanger operating conditions. In the case of engine oil, this predetermined minimum amount is preferably about 10%, but it could be as high as 20% when the oil is hot. In the case of transmission oil or fluid, the predetermined minimum amount preferably is about 15%, but it could be as high as 30% under hot operating temperature conditions.

The orifices are also dimensioned so that if engine or transmission oil is the fluid passing through the heat exchanger, the flow rate of the oil through the heat exchanger is maintained above a predetermined lower limit at all operating temperatures, including cold start up conditions. For engine oil this predetermined lower limit is about 8 liters (2 U.S. gallons) per minute. For transmission fluid, the predetermined lower limit is about 2 liters (0.5 U.S. gallons) per minute.

The orifice should also be dimensioned so that the heat exchanger outlet pressure is at least 20 psi (3 kPa) approximately 30 seconds after the engine starts in the case of engine oil. In the case of transmission oil or fluid, the flow rate through the heat exchanger should be at least 2 liters per minute (0.5 U.S. gallons) per minute approximately 10 minutes from cold engine start.

It has been found that in typical automotive oil coolers, in order to satisfy the above heat transfer criteria, the maximum orifice diameter should be between 1.5 and 3.6 milimeters where engine oil is the fluid passing through the heat exchanger. In order to satisfy the above oil pressure drop criteria, the minimum orifice should be between 0.2 and 1.5 milimeters. In any event, the orifices should not exceed 6.4 milimeters in diameter. Of course, if the configuration or shape of the orifices are different than a simple circular hole, then the equivalent hydraulic diameter should be within the above-mentioned limits.

The manufacture of the heat exchangers described above is preferably done by employing brazing clad aluminum for the various components, assembling the components in the desired configuration and furnace brazing the assembly to complete the heat exchangers. Other methods and materials can be used, however, as will be appreciated by those skilled in the art.

Having described preferred embodiments of the invention, it will be appreciated that various modifications may be made to the structures described above. For example, in the FIG. 1 to 5 embodiments, the oil filter could be eliminated if all that is required is the heat exchanger. Similarly, the plate pairs 22 could be eliminated if the oil filter itself is enough of a heat exchanger. The embodiments shown in FIGS. 6 through 11 and the various features incorporated therein could be interchanged or mixed and matched, as desired. In all of the embodiments described above, the size and overall shape of the heat exchanger can be modified as desired.

It will be apparent to those skilled in the art that in light of the foregoing disclosure, many alterations and modifications are possible in the practise of this invention without departing from the spirit or scope thereof. Accordingly, the scope of the invention is to be construed in accordance with the substance defined in the following claims.

What we claim is:

1. A heat exchanger comprising: a housing defining a fluid inlet chamber and a fluid outlet chamber; means defining a plurality of heat exchange passages located between and communicating with the inlet and outlet chambers, the heat exchange passages having inlet passages defining an inlet flow manifold communicating with the inlet chamber; a separator located adjacent to the inlet flow manifold; and said separator defining a calibrated bypass orifice therethrough located remote from the inlet passages and communicating with the inlet flow manifold for the continuous flow out of the inlet flow manifold of a portion only of the fluid entering the inlet flow manifold.

2. A heat exchanger as claimed in claim 1 wherein the separator is a plate, and wherein said orifice is a hole in the plate.

3. A heat exchanger as claimed in claim 1 and further comprising a flow diverter located between the orifice and the fluid outlet chamber, said flow diverter including a bypass channel formed therein communicating between said orifice and the fluid outlet chamber.

4. A heat exchanger as claimed in claim 1 wherein the separator is a baffle located in the inlet chamber to define a bypass chamber, said baffle having a hole formed therethrough to form said orifice, and further comprising means defining a bypass channel communicating between the bypass chamber and the fluid outlet channel.

5. A heat exchanger as claimed in claim 1 wherein the orifice is shaped to minimize pressure losses therethrough when the fluid static pressure in the fluid inlet chamber adjacent to the orifice is highest.

6. A heat exchanger as claimed in claim 1 wherein the bypass orifice is located so that it has minimal negative effect on the flow distribution through the heat exchange passages.

7. A heat exchanger as claimed in claim 6 wherein the orifice is located remote from the heat exchange passages.

8. A heat exchanger as claimed in claim 1 wherein the bypass orifice is dimensioned so that the heat transfer reduction in the heat exchanger caused by the flow through the bypass orifice does not exceed a minimum predetermined limit.

9. A heat exchanger as claimed in claim 8 wherein the predetermined limit is between 5 and 10 percent of the heat transfer rate of the heat exchanger without an orifice.

10. A heat exchanger as claimed in claim 8 wherein the predetermined limit is between 5 and 25 percent of the heat transfer rate of the heat exchanger without an orifice.

11. A heat exchanger as claimed in claim 1 wherein the bypass orifice is dimensioned so that it reduces the fluid pressure drop in the heat exchanger by a predetermined minimum amount compared to the same heat exchanger with no orifice.

12. A heat exchanger as claimed in claim 11 wherein the predetermined minimum amount is between 10 and 15 percent.

13. A heat exchanger as claimed in claim 1 wherein the bypass orifice is dimensioned so that it reduces the fluid pressure drop in the heat exchanger thereby increasing fluid flow through the heat exchanger by a predetermined amount.

14. A heat exchanger as claimed in claim 13 wherein the predetermined amount is between 10 and 30 percent under normal steady state heat exchanger operating conditions.

15. A heat exchanger as claimed in claim 13 wherein the predetermined amount is between 10 and 20 percent where hot engine oil is the fluid.

16. A heat exchanger as claimed in claim 1 wherein the bypass orifice is dimensioned so that if oil is the fluid passing through the heat exchanger, the flow rate of oil through the heat exchanger is maintained above a predetermined lower limit at all normal operating temperatures.

17. A heat exchanger as claimed in claim 16 wherein said predetermined lower limit is 2 liters per minute.

18. A heat exchanger as claimed in claim 8, wherein the maximum bypass orifice diameter is between 1.5 and 3.6 mm where engine oil is the fluid.

19. A heat exchanger as claimed in claim 16, wherein the maximum bypass orifice diameter is between 1.5 and 3.6 mm where engine oil is the fluid.

20. A heat exchanger as claimed in claim 8 wherein the minimum bypass orifice diameter is between 0.2 and 1.5 mm where engine oil is the fluid.

21. A heat exchanger as claimed in claim 16 wherein the minimum bypass orifice diameter is between 0.2 and 1.5 mm where engine oil is the fluid.

22. A heat exchanger as claimed in claim 8 wherein the orifice diameter is less than 6.4 mm.

23. A heat exchanger as claimed in claim 16 wherein the orifice diameter is less than 6.4 mm.

* * * * *